US008347495B2

(12) United States Patent
Biesse et al.

(10) Patent No.: US 8,347,495 B2
(45) Date of Patent: Jan. 8, 2013

(54) METHOD OF EXTENDING THE INDIVIDUAL ELECTROMAGNETIC SHIELDING OF ELECTRICAL STRANDS IN A TWISTED-STRAND CABLE TO AN ELECTRICAL CONNECTOR

(75) Inventors: Jean-luc Biesse, Saint Lieux les Lavaurs (FR); Sébastien Guerrero, Fronton (FR); Didier Laurent, Fronton (FR)

(73) Assignee: Labinal, Blagnac (FR)

( * ) Notice: Subject to any disclaimer, the term of this patent is extended or adjusted under 35 U.S.C. 154(b) by 158 days.

(21) Appl. No.: 12/933,605

(22) PCT Filed: Mar. 18, 2009

(86) PCT No.: PCT/FR2009/050448

§ 371 (c)(1),
(2), (4) Date: Feb. 16, 2011

(87) PCT Pub. No.: WO2009/122093

PCT Pub. Date: Oct. 8, 2009

(65) Prior Publication Data

US 2011/0146072 A1 Jun. 23, 2011

(30) Foreign Application Priority Data

Mar. 19, 2008 (FR) ..... 08 01498

(51) Int. Cl.
*H01R 43/00* (2006.01)

(52) U.S. Cl. ..... 29/857; 29/861; 29/874; 29/876

(58) Field of Classification Search ..... 29/857, 29/861, 862, 874, 876, 887; 174/75 C; 439/98, 439/99, 275, 452, 578, 585, 607.44, 675
See application file for complete search history.

(56) References Cited

U.S. PATENT DOCUMENTS

| | | | | |
|---|---|---|---|---|
| 2,941,028 | A * | 6/1960 | Edlen et al. | 174/75 C |
| 4,755,152 | A * | 7/1988 | Elliot et al. | 439/452 |
| 5,211,576 | A | 5/1993 | Tonkiss et al. | |
| 5,746,625 | A | 5/1998 | Aparicio et al. | |
| 6,107,572 | A | 8/2000 | Miyazaki | |
| 7,119,281 | B2 | 10/2006 | Sato et al. | |
| 2006/0090921 | A1 | 5/2006 | Sato et al. | |

FOREIGN PATENT DOCUMENTS

| | | |
|---|---|---|
| EP | 0 739 057 | 10/1996 |
| JP | 2 129873 | 5/1990 |

* cited by examiner

*Primary Examiner* — Thiem Phan
(74) *Attorney, Agent, or Firm* — Oblon, Spivak, McClelland, Maier & Neustadt, L.L.P.

(57) ABSTRACT

End segments of cables are stripped of their individual shielding coverings so as to form unit shielding pigtails extending from a terminal portion of the strand from which shielding has not been removed and around which a conductive packing strip has been wound so as to reach a predetermined diameter. The pigtails are folded back and distributed uniformly around the circumference of the terminal portion of the strand in the successive turns of the packing strips. The packing strip is clamped by an annular reinforcing spring blade, and then the assembly is surrounded within two half-shells that are coupled to each other and connected to the connector.

6 Claims, 7 Drawing Sheets

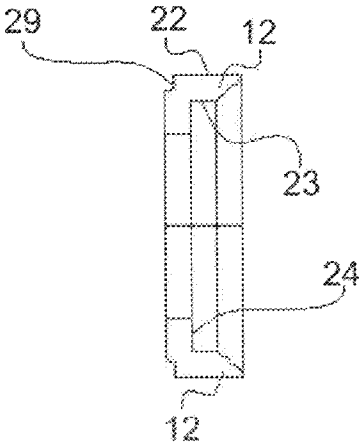
FIG.9
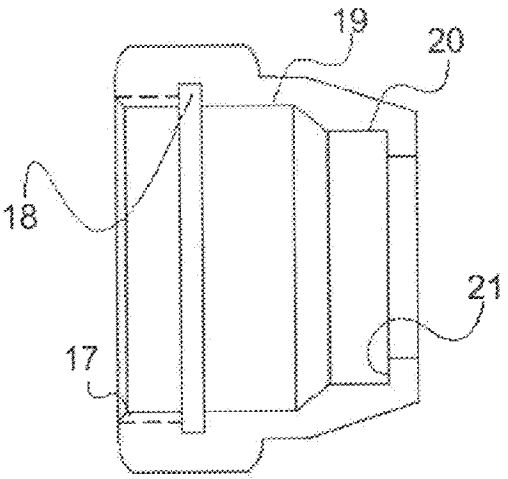
FIG.10
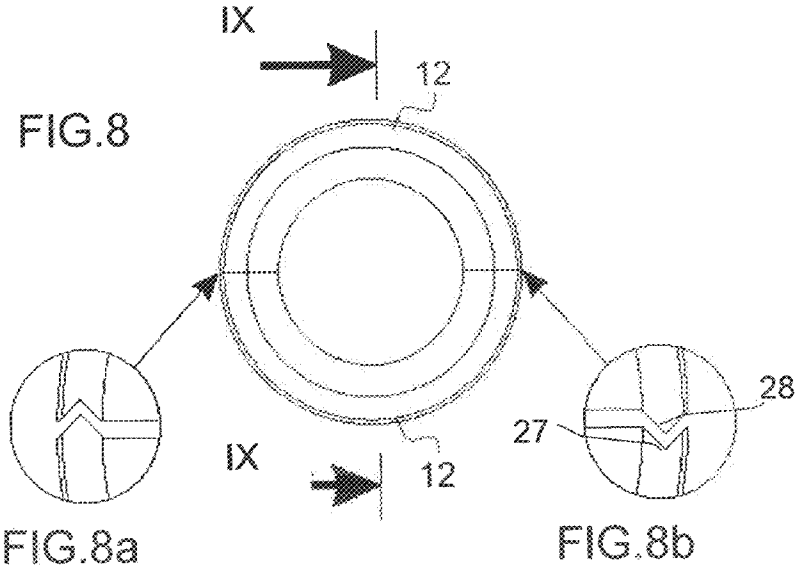
FIG.8
FIG.8a
FIG.8b

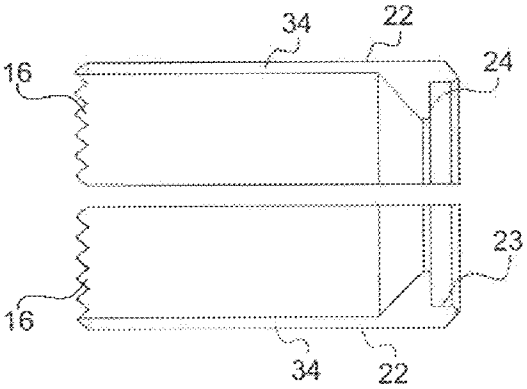
FIG.14
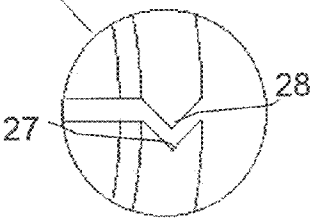
FIG.13b
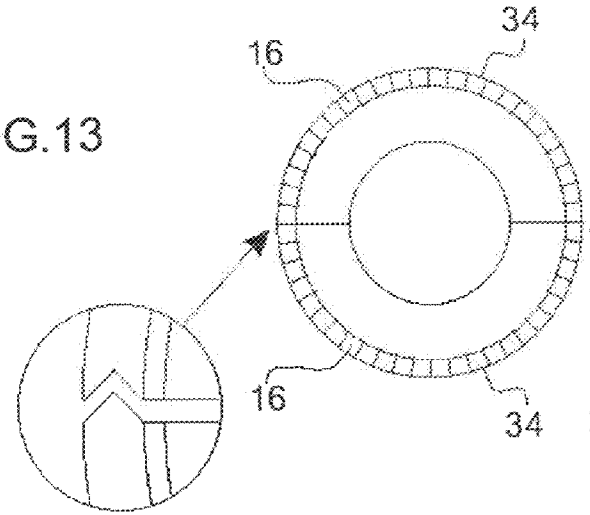
FIG.13
FIG.13a
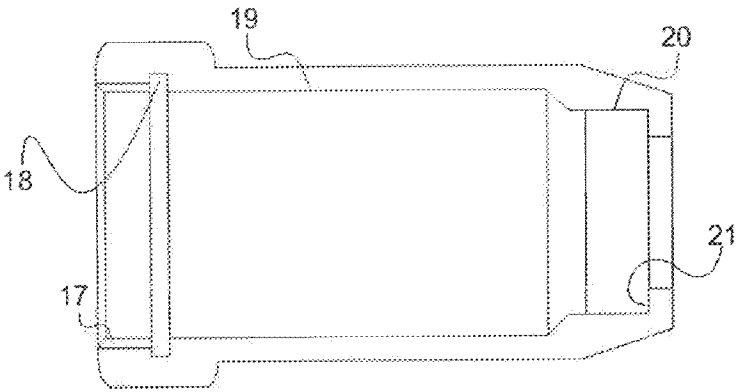
FIG.15

METHOD OF EXTENDING THE INDIVIDUAL ELECTROMAGNETIC SHIELDING OF ELECTRICAL STRANDS IN A TWISTED-STRAND CABLE TO AN ELECTRICAL CONNECTOR

The present invention relates to a method of extending the individual electromagnetic shielding of electrical cables in cable-strand to an electrical connector. The invention applies in particular to connection cables used in the aviation industry.

In order to provide good protection to conductive cables, it is desirable to establish electromagnetic continuity between the individual shielding coverings of the cables of the strand and the connector, and more particularly its backcoupling. For this purpose, it is known to incorporate means in a connector backshell for the purpose of extending the individual shielding of the cables thereto.

Patent EP 0 739 057 describes an example of such a backcoupling with offset shielding extension. The end segments of the cables are stripped of their individual shielding coverings so that each covering projecting in this way from the corresponding cable forms a unitary shielding strap known as a "pigtail" that extends from a terminal portion of the strand from which shielding has not been removed. These pigtails are placed against an anvil ring at the rear of the backcoupling. A braid crimped onto the front of the connector is then crimped via a crimping ring over the individual shielding coverings of the cables.

The mechanical stresses exerted by the fastener means against the anvil nevertheless tend to damage the shielding coverings. The portion of the strand extending between the front clamping core of the backshell and the anvil is very fragile. The free length of the pigtails (about 5 centimeters (cm) to 10 cm), given the distance between the anvil and the connector and given the slack required for not subjecting the pigtails to stress, increases transmission faults associated with crosstalk and thus significantly degrades the electromagnetic protection performance of the shielding coverings as connected in this way. Furthermore, on each occasion that the connector is disassembled for maintenance or repair purposes and is then reassembled, it is necessary to cut off the ends of the unit shielding pigtails that have been damaged by the crimping. It is therefore necessary to provide these pigtails with excess length.

International application WO 96/33524 describes another example of such a connector backshell, referred to as a "chimney". That chimney is removable. The pigtails are placed over the rear chimney of the backshell to which they are connected by crimping, by a metal band, by a ring having shape memory, by a reinforcing spring, etc. As in the above-described example, the free length (i.e. length without actual electrical contact) of the pigtails degrades the electromagnetic protection performance of the shielding coverings as connected in this way, particularly since the pigtails need to be of excess length in order to allow for at least two disassembly operations for maintenance or repair purposes. The mechanical stresses exerted by the fastener means against the chimney thus tend to damage the shielding coverings. Finally, the diameter of the rear outlet of the backshell must necessarily match the diameter of the strand, which means that a large number of different backshell references need to be provided in order to match strand diameters: such a solution is thus very expensive.

Other types of connector backshell exist that include means for extending the individual shielding of the cables, such as backshells involving cable glands or crenellations or fittings, in which the pigtails are brought against a gland system or against a fastener point by means of a fitting provided on the backshell. Nevertheless, such backshells give rise to substantially the same difficulties as those mentioned above in terms of the mechanical stresses exerted on the pigtails, of the length thereof, or of matching the backshell to the diameter of the strand.

The present invention seeks to avoid those drawbacks by proposing a simple and inexpensive method of extending the individual shielding of cables of a connector, in which the pigtails are not damaged by the coupling means and making it possible to optimize the length of the unit shielding pigtails and to limit the number of backcoupling references that need to be provided depending on the size of the strand.

To this end, the invention provides a method of extending the individual electromagnetic shielding of electrical cables of a cable-strand to an electrical connector, said method consisting in:

- stripping end segments of the cables of their individual shielding coverings so that each covering as removed in this way from the corresponding cables forms a unit shielding pigtail extending from a terminal portion of the strand from which the shielding has not been removed;
- connecting said ends of the cables to the connector;
- winding a conductive packing strip around said terminal portion of the strand until the diameter thereof reaches a predetermined value, while folding back and distributing said unit shielding pigtails in uniform manner around the circumference of the terminal portion of the strand within at least one or two successive turns of the packing strips;
- surrounding said packing strip wound around the terminal portion of the strand with a reinforcing spring blade of annular shape;
- surrounding the reinforcing spring blade within two electrically-conductive half-shells including complementary coupling means; and
- coupling said half-shells to each other and connecting them mechanically and electrically to the connector.

The conductive packing strip serves to fill in the gap between a strand and its backshell, regardless of the diameter of the strand, and to avoid excessively stressing the individual shielding pigtails of the cables. The length of the pigtails is reduced to a few millimeters.

In an advantageous possibility, said terminal portion of the strand has protective tape around therearound before the packing strip is wound around the terminal portion of the strand as taped in this way. The taping serves to provide the cables of the strand with mechanical protection.

In an implementation, the electrical connection between the two half-shells of the connector is provided by means of an annular shoulder formed at the front of an external wall of each half-shell and designed to be clamped against an internal annular wall of a backshell of the connector.

In another implementation, the electrical connection between the two half-shells of the connector is provided by means of an annular set of teeth formed at the front of the half-shells and designed to couple with a set of teeth of complementary shape of the connector.

In an advantageous possibility, the mechanical connection between the two half-shells and the connector is provided by means of a rear nut in which the assembly of said half-shells together with the reinforcing spring blade is received and comes to bear, said rear nut being screwed onto a threaded portion of the connector or of the backshell of the connector.

The rear nut serves to provide control over the clamping torque exerted and to apply pressure to the assembly.

By way of example, the coupling means of the half-shells comprise a tangentially-oriented indentation formed at a first end of the arc formed by each half-shell, and a projection of complementary shape formed at the other end of the arc.

This method is applicable regardless of the type, the size, or the number of cables. The invention can in any event be better understood and other advantages thereof appear more clearly in the light of the description of two implementations given as non-limiting examples and made with reference to the accompanying drawings, in which:

FIG. 8 is an end view showing how two half-shells visible in FIGS. 6 and 7 are assembled together; FIGS. 8*a* and 8*b* being detail views of coupling means of the FIG. 8 half-shells;

FIG. 9 is a section view on line IX-IX of FIG. 8;

FIG. 10 is a longitudinal section view of a rear nut that is visible in FIGS. 6 and 7; and FIGS. 11 to 15 are views analogous to the views of FIGS. 6 to 10, showing a second example of the method of the invention.

Figure 1:
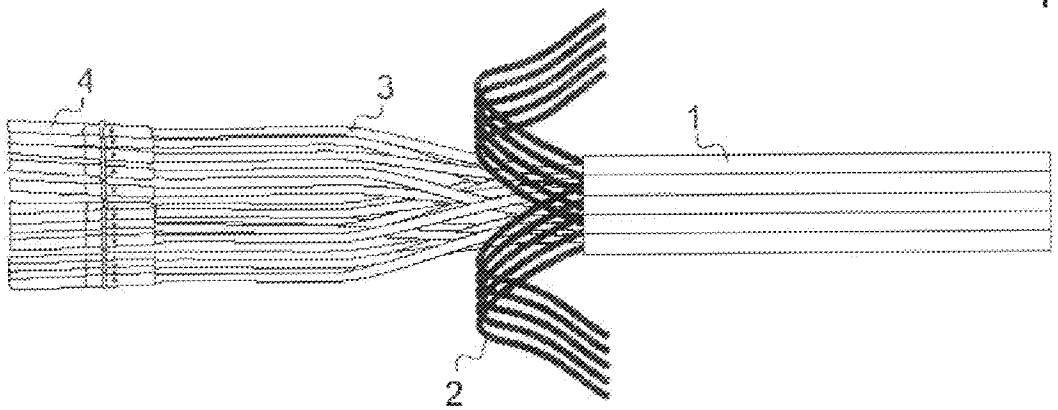
FIGS. 1 to 4 are diagrammatic longitudinal views showing four successive stages in implementing a first example of a method of extending the individual shielding of the cables of a cable-strand to an electrical connector.

FIG. 1 shows a plurality of shielded electrical cables forming a cable-strand 1 and including contact terminations 4. A first step of the method consists in stripping the individual shielding coverings from the end segments of the cables of the strand 1 so that each covering as removed in this way from the corresponding bare cable 3 forms a unitary strap 2 of shielding referred to as a "pigtail" that extends from a terminal portion of the strand 1 that has not has its shielding removed.

Figure 2:
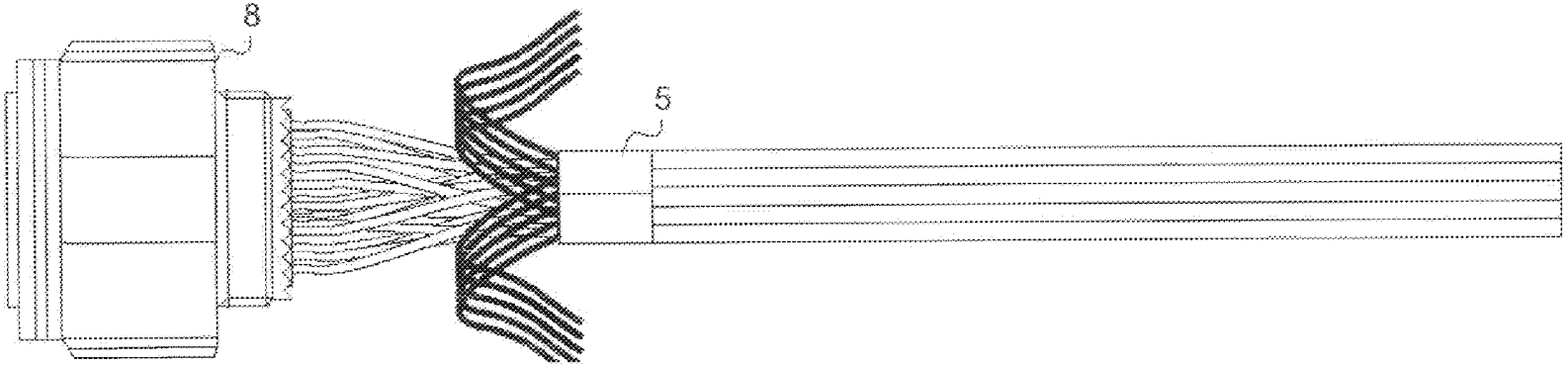

As shown in FIG. 2, the terminations 4 of the cables are connected to an electrical connector 8, and tape 5 is wound around the terminal portion of the strand 1. This tape 5 provides mechanical protection for the cables of the strand 1.

Figure 3:
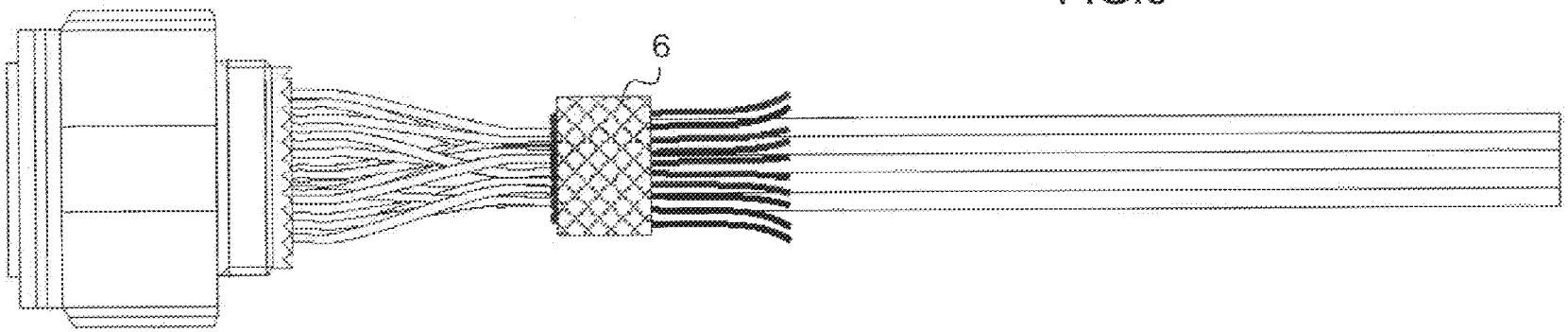

Subsequently, a strip of conductive packing 6 is wound around the taped terminal portion of the cable 1 (see FIG. 3), and the individual shielding pigtails 2 are folded back, being distributed uniformly around the circumference of the terminal portion of the cable 1, between successive turns of the packing strip 6. This operation of winding the packing strip 6 is continued until the diameter of this terminal portion of the strand 1 reaches a predetermined value.

Figure 4:
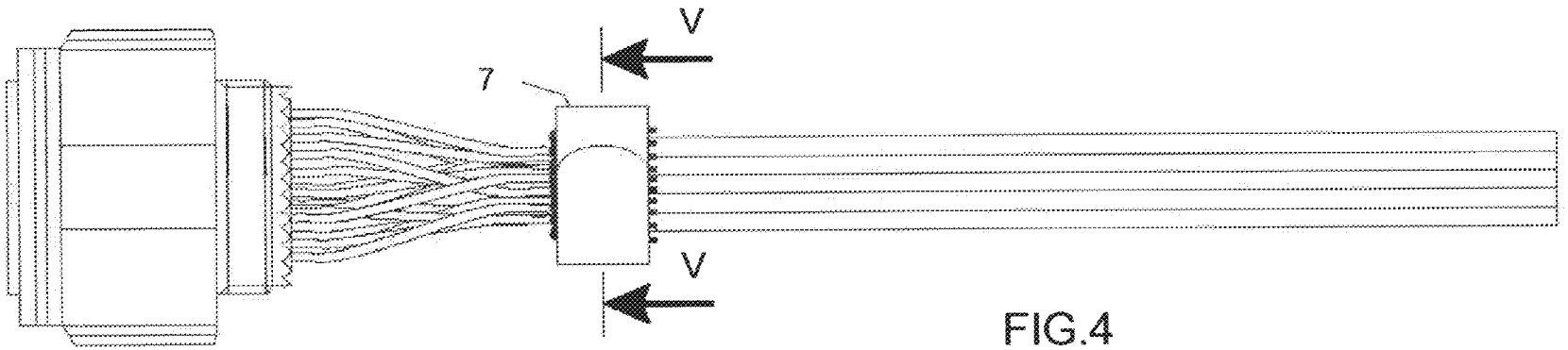
Figure 5:
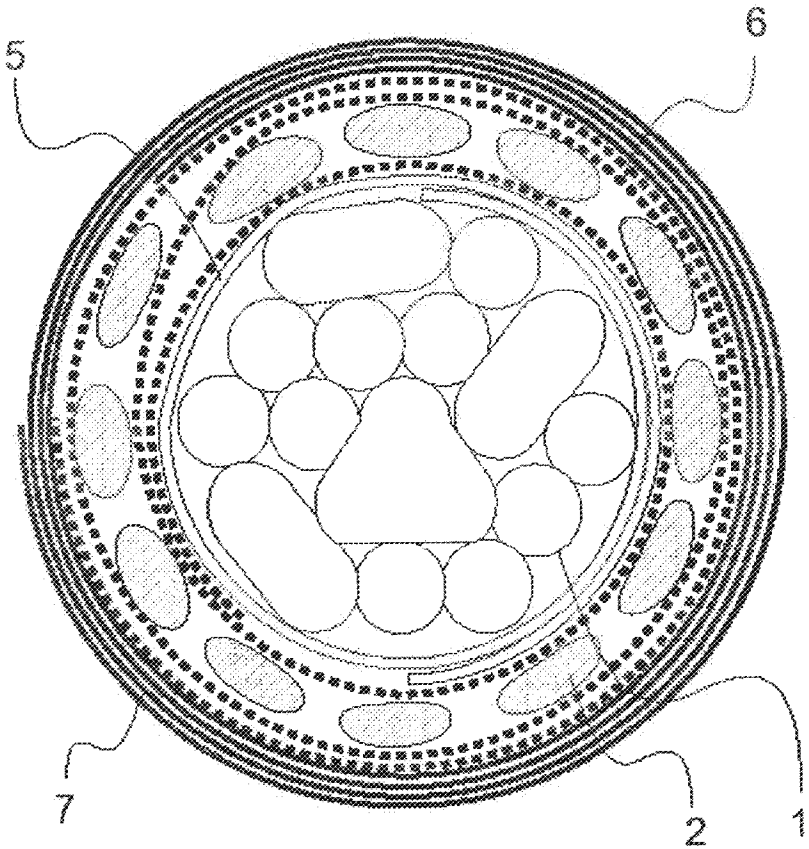
FIG. 5 is a section view on line V-V of FIG. 4.

Finally, as shown in FIGS. 4 and 5, the packing strip 6 as wound around the terminal portion of the cable 1 is surrounded and clamped at constant force by a reinforcing spring blade 7 of annular shape. The method is identical whatever the size of the connector 8 or the cable 1, or the number or type of cables.

Figure 6:
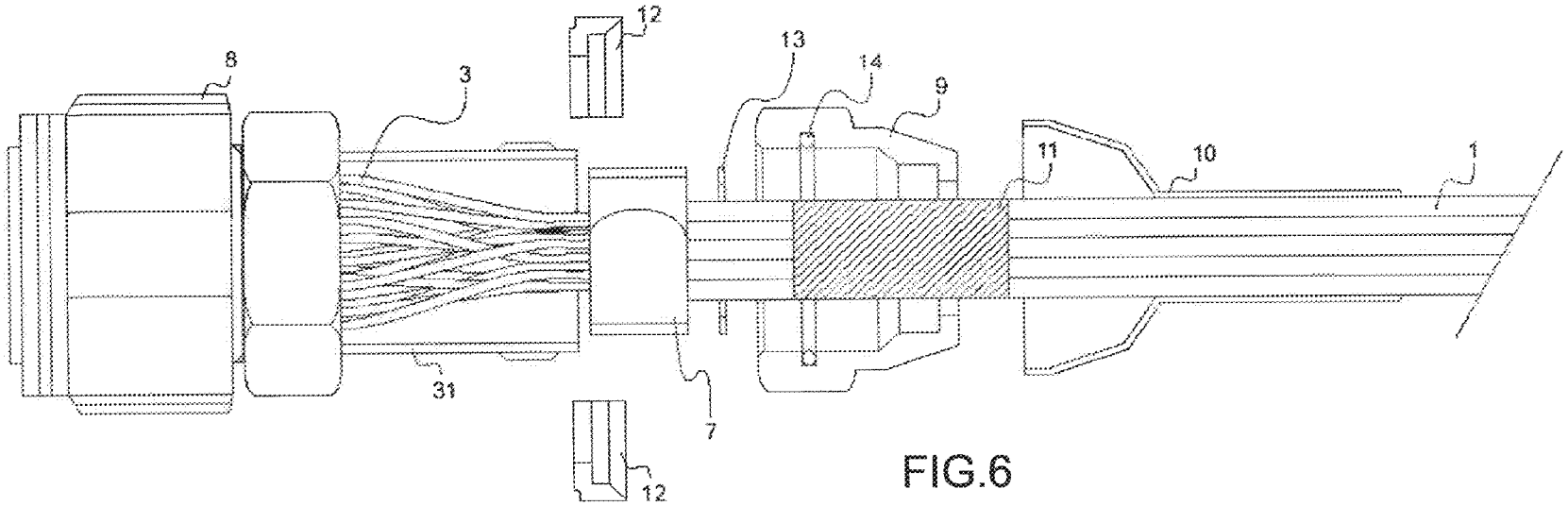
FIGS. 6 and 7 are longitudinal views partially in section showing the last steps of the method.
Figure 7:
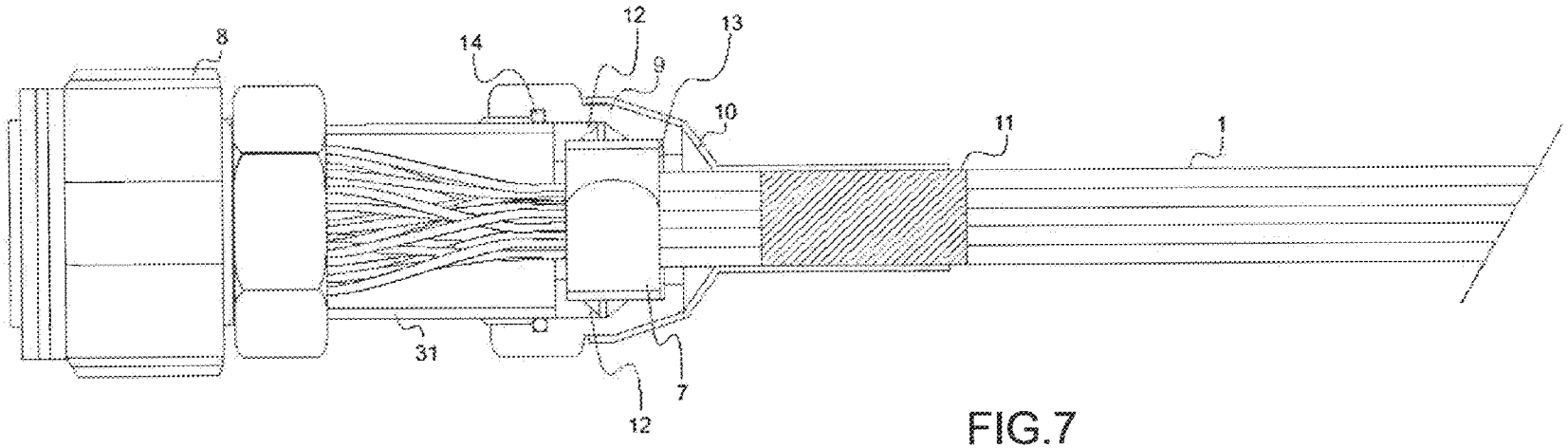
Figure 11:
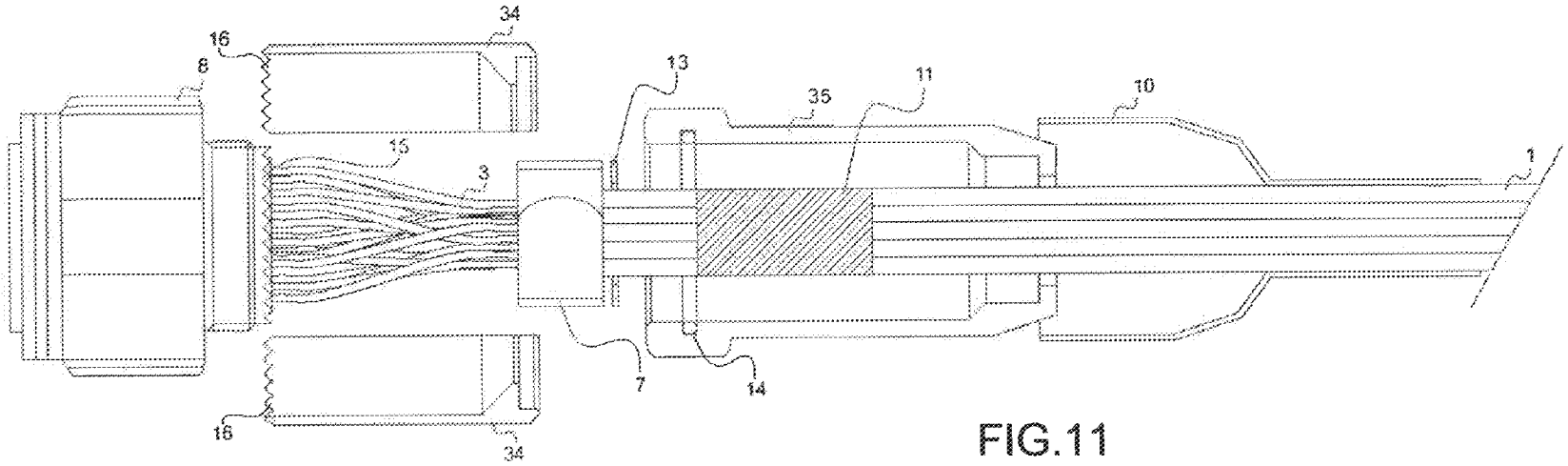
Figure 12:
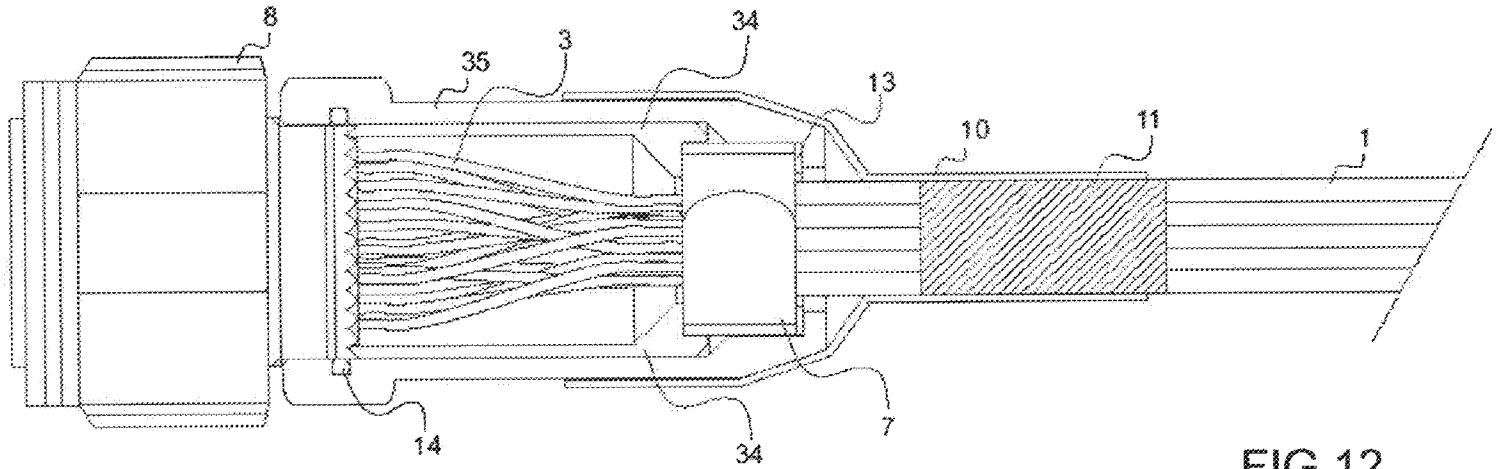

The shielding 2 of the cables and of the connector 8 are put to the same electrical potential by means of two half-shells 12 (see FIGS. 6 to 8).

A front portion (i.e. to the left in the longitudinal view) of the reinforcing spring blade 7 is surrounded between the two electrically-conductive half-shells 12 that are coupled together and connected to an electrically-conductive backshell 31 of the connector 8. In this example, the backshell 31 is straight, but it could very well be angled, e.g. through 45° or 90°.

An internal annular shoulder 24 in each half-shell 12 bears against said front portion of the reinforcing spring blade 7. An internal annular wall 23 of each half-shell 12 bears against the reinforcing spring blade 7, thereby ensuring that it is centered and properly positioned.

The two half-shells 12 are electrically connected to the backshell 31 of the connector 8 by means of an annular shoulder 29 formed at the front of an outer annular wall 22 of each of the assembled-together half-shells 12 (see FIG. 9). The annular shoulder 29 is clamped to bear against an internal annular wall of the backcoupling 31 (see FIG. 7).

The shoulders 24 and 29 of the half-shells 12 form part of the path followed by any current flowing between from the individual shielding pigtails 2 to the connector 8.

The coupling means of the half-shells 12 (see FIGS. 8*a* and 8*b*) comprise a tangentially-oriented indentation 27 formed at a first end of the arc constituted by the half-shell 12, and a projection 28 of shape complementary to said indentation and formed at the other end of the arc. These two indentation and projection pairs 27 and 28 form a self-centering system that provides a baffle for electromagnetic waves. This system serves to limit as well as possible any penetration of electromagnetic disturbances into the Faraday chamber formed by the backshell 31.

The two half-shells 12 are mechanically coupled to the connector 8 by means of a rear nut 9 in which the assembly comprising the half-shells 12 together with the reinforcing spring blade 7 is received and comes to bear. The rear nut 9 is screwed via a tapped portion 17 (see FIG. 10) onto a threaded portion of the backshell 31. The rear nut 9 is a hexagonal nut having six flats 25 enabling it to be tightened to torque. It does not conduct electricity.

The external annular walls 22 of the two half-shells 12 enable them to be centered and properly positioned bearing against an internal annular wall 19 of large diameter in the rear nut 9. A small-diameter internal annular wall 20 defining a well in the rear nut 9 serves to center and properly position the reinforcing spring blade 7. An anti-friction washer 13 is placed against the end 21 of the well in the rear nut 9. The reinforcing spring blade 7 receives pressure from the end of the well 21 in the rear nut 9 via the thrust washer 13. An O-ring 14 placed in an annular groove 18 formed in the internal wall 19 of the rear nut 9 provides sealing between the rear nut 9 and the backshell 31.

The reinforcing spring blade 7 compresses the packing 6 against the shield pigtails 2 and provides the terminal portion of the strand 1 as wrapped in this way with geometrical cohesion in terms of diameter (matching the backshell) and width (bearing surface that ought not to be deformed for mechanically preventing the rear nut 9 from moving).

In known manner, a sealing sleeve 11 is installed on the strand 1, and then a heat-shrink sheath 10 provides sealing between the rear nut 9 and the sleeve 11 by leaktight adhesion.

By means of this method, the shielding pigtails 2 are not damaged by being coupled, they are of moderate length, and the cables are protected inside the backshell 31.

Another example of the method of the invention is shown in following FIGS. 11 to 15. In this example, the number of parts has been optimized, but this optimization is applicable only to a straight backshell. The function of coupling to the connector is provided by half-shells 34. That is why the external walls 22 of the half-shells 24 are greatly lengthened (see FIG. 14). The large-diameter internal wall 19 of the rear nut 35 is also extended correspondingly (see FIG. 15).

Electrical coupling is implemented directly between the two half-shells 34 and the connector 8 by means of an annular set 16 of coupling teeth (see FIGS. 13 and 14) formed at the front ends of the half-shells 34. This set of teeth 16 is designed to couple with a set of teeth 15 of complementary shape forming part of the connector 8. The shape of the coupling set of teeth 16 of the half-shells 34 depends on the standard to which the connector 8 that receives the coupling complies. The sets of teeth 15 and 16 form portions of the path via which any current flows from the individual pigtails 2 of the cables to the connector 8.

It is also possible to associate extending the individual shielding of the cables with an additional system, known from elsewhere, serving to restore the general shielding of the strand 1 (e.g. a metal braid, overlying metal braiding, a shielded open sheath, . . . ). Under such circumstances, the rear nut (9 or 35) must be electrically conductive.

The invention thus makes it possible easily and simply and without requiring special tooling or any source of electricity or heat, to repair or adapt an electrical harness without there being any need to degas the aircraft beforehand or to identify each strand.

Naturally, and as can be seen from the above, the invention is not limited to the particular implementations described above; on the contrary, it encompasses any variant implementation or application coming within the ambit of the following claims.

The invention claimed is:

1. The method of extending the individual electromagnetic shielding of electrical cables of a cable-strand to an electrical connector, said method comprising:

a) stripping end segments of the cables of their individual shielding coverings so that each covering as removed in this way from the corresponding cables forms a unit shielding pigtail extending from a terminal portion of the strand from which the shielding has not been removed;

b) connecting said ends of the cables to the connector;

c) winding a conductive packing strip around said terminal portion of the strand until the diameter thereof reaches a predetermined value, while folding back and distributing said unit shielding pigtails in uniform manner around the circumference of the terminal portion of the strand within at least one or two successive turns of the packing strips;

d) surrounding said packing strip wound around the terminal portion of the strand with a reinforcing spring blade of annular shape;

e) surrounding the reinforcing spring blade within two electrically-conductive half-shells including complementary coupling means; and f) coupling the half-shells to each other and connecting them mechanically and electrically to the connector.

2. The method of extending shielding according to claim 1, wherein the terminal portion of the strand has protective tape therearound before the packing strip is wound around the terminal portion of the strand as taped in this way.

3. The method of extending shielding according to claim 1, wherein the electrical connection between the two half-shells of the connector is provided by an annular shoulder formed at the front of an external wall of each half-shell and configured to be clamped against an internal annular wall of a backcoupling of the connector.

4. The method of extending shielding according to claim 3, wherein the mechanical connection between the two half-shells and the connector is provided by a rear nut in which the assembly of the half-shells together with the reinforcing spring blade is received and comes to bear, the rear nut being screwed onto a threaded portion of the connector or of the backcoupling of the connector.

5. The method of extending shielding according to claim 1, wherein the electrical connection between the two half-shells of the connector is provided by an annular set of teeth formed at the front of the half-shells and configured to couple with a set of teeth of complementary shape of the connector.

6. The method of extending shielding according to claim 1, wherein the coupling means of the half-shells comprises a tangentially-oriented indentation formed at a first end of the arc formed by each half-shell, and a projection of complementary shape formed at the other end of the arc.

* * * * *